United States Patent [19]

Robinson

[11] Patent Number: 4,531,700

[45] Date of Patent: Jul. 30, 1985

[54] ELECTRIC MOTOR MOUNTING ARRANGEMENT

[75] Inventor: Carl W. Robinson, Charlotte, N.C.

[73] Assignee: International Business Machines Corporation, Armonk, N.Y.

[21] Appl. No.: 619,229

[22] Filed: Jun. 11, 1984

[51] Int. Cl.[3] ..... A47H 1/10

[52] U.S. Cl. ..... 248/672; 248/674; 310/91

[58] Field of Search ..... 248/672, 560, 558, 674, 248/675, 222.2, 222.3, 544; 310/51, 91, 89

[56] References Cited

U.S. PATENT DOCUMENTS

| | | | |
|---|---|---|---|
| 2,165,191 | 7/1939 | Kucher | 310/91 UX |
| 2,510,680 | 6/1950 | Byrnes | 248/672 X |
| 3,145,910 | 8/1964 | Jolly | 230/117 |
| 3,531,070 | 9/1970 | Roddy | 248/15 |
| 3,536,280 | 10/1970 | Barlow | 248/13 |
| 3,746,289 | 7/1973 | Johnsen | 310/91 X |
| 3,787,014 | 1/1974 | Story | 248/558 |
| 3,870,908 | 3/1975 | Button | 310/91 |
| 3,941,339 | 3/1976 | McCarty | 310/91 X |
| 4,155,020 | 5/1979 | Skare | 310/91 |
| 4,253,634 | 3/1981 | Daniels | 248/604 |
| 4,260,125 | 4/1981 | Levine | 248/675 |
| 4,426,593 | 1/1984 | Chernoff et al. | 310/91 |
| 4,441,347 | 4/1984 | Taylor | 248/222.3 X |

*Primary Examiner*—J. Franklin Foss

*Attorney, Agent, or Firm*—E. Ronald Coffman

[57] ABSTRACT

The mounting arrangement permits the mounting of a face mounted electric motor in right-angular relationship on a support frame member without requiring the use of separate fasteners, such as screws and the like, and is of particular value when mounting of the motor by robotic techniques. The motor is provided with a mounting flange having a pair of diametrically opposed outwardly extending mounting ears with mounting openings provided therein. A pair of motor support members is provided on the support frame and includes semi-spherical cam projections which are aligned with the openings in the mounting flange when the mounting face of the motor is positioned against the support frame and rotated until the semi-spherical cam projections snap into position in the openings in the mounting ears.

11 Claims, 6 Drawing Figures

ELECTRIC MOTOR MOUNTING ARRANGEMENT

FIELD OF THE INVENTION

This invention relates generally to an electric motor mounting arrangement and more particularly to a mounting arrangement which permits the rigid mounting of a face mounted electric motor in right-angular relationship on a support frame member without requiring the use of separate fasteners, such as screws and the like.

BACKGROUND OF THE INVENTION

Most face mounting electric motors are provided with a mounting flange fixed on the drive shaft end of the electric motor and are maintained in position on a supporting frame member by screws or bolts which extend through mating openings in the mounting flange and the supporting frame member. This conventional type of electric motor mounting requires manual alignment of the flange openings with the supporting frame openings and inserting and tightening of the mounting screws or bolts.

It is also known to provide a motor mounting arrangement in which the mounting flange of the electric motor is provided with keyhole-type openings and bolts or screws are threadably supported in the supporting frame. In this type of mounting arrangement, the large end of the keyhole opening in the mounting flange is manually aligned with and moved inwardly to surround the head of the bolt or screw. The motor and mounting flange are then rotated to move the bolts or screws into a locking position with the narrow portion of the keyhole slots engaging the shank of the bolts or screws. The bolts or screws are then tightened to hold the motor in locked position on the supporting frame. This mounting arrangement also requires manual alignment of the keyhole slots with the bolts or screws and tightening of the bolts or screws.

SUMMARY OF THE INVENTION

With the foregoing in mind, it is an object of the present invention to provide a mounting arrangement for rigidly supporting a face mounted electric motor on a supporting frame by a simple positioning and rotating motion of the electric motor, without requiring the use of bolts or screws, so that the electric motor can be mounted in position using robotic techniques.

In accordance with the present invention, the electric motor is provided with a mounting flange fixed to the drive shaft end of the motor housing and the mounting flange includes a pair of mounting ears extending outwardly from substantially diametrically opposed positions at opposite sides of the mounting flange. Mounting openings, normally provided for insertion of screws or bolts, are formed in the mounting ears and are concentric with the drive shaft.

The mounting arrangement of the present invention is adapted for use with this conventional type of face mounted electric motor and includes a support frame for supporting the electric motor in a right-angular position thereon. An opening is provided in the support frame for passage of the drive shaft through the frame and a bearing surface is provided on one side of the frame and adjacent the opening to mate with a corresponding bearing surface on the mounting flange of the electric motor.

A pair of motor support members is fixed on diametrically opposed sides of the opening in the support frame and includes inner portions fixed on one side of the frame and outer portions extending at a right angle to the inner portions and in parallel spaced-apart relationship with the support frame. The outer end portions are provided with inner surfaces spaced from the support frame substantially the same distance as the thickness of the flange ears. Cam projections extend inwardly from the inner surfaces of the outer end portions of the support members and are positioned and dimensioned to engage the openings in the flange ears with positioning of the bearing surface of the mounting flange against the bearing surface of the support frame and rotation of the electric motor and the mounting flange to resiliently maintain the mounting flange in locked position on the support frame.

It is preferred that the support frame be molded of polymer material, such as glass fiber filled polycarbonate, and that the support members be integrally molded with the support frame so that the support members have sufficient flexibility and resiliency to permit the cam projections to spring the support members outwardly when the motor is rotated to the locking position on the support frame. The cam projections snap into at least partially seated locking position with the openings in the mounting flange to maintain the motor in position. It is also preferred that the cam projections be semi-spherical and that the flat inner surface be integrally molded with the inner surface of the outer portion of the support member.

BRIEF DESCRIPTION OF THE DRAWINGS

Other objects and advantages will appear as the description proceeds when taken in connection with the accompanying drawings, in which.

DESCRIPTION OF THE ILLUSTRATED EMBODIMENT

Figure 1:
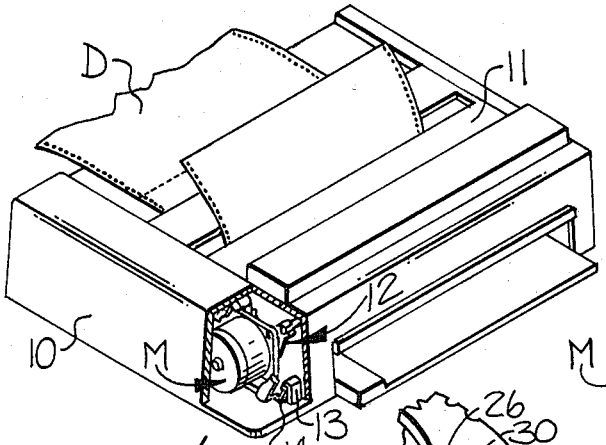
FIG. 1 is an isometric view of a computer output printer with one corner of the housing being broken away to illustrate the present motor mounting arrangement associated therewith.

The electric motor mounting arrangement of the present invention is illustrated as being utilized to support an electric stepping motor for imparting back and forth movement to the print head of a computer output printer. However, it is to be understood that the present electric motor mounting arrangement can be used to support other types of electric motors on supporting frames in other types of machines. The particular printer illustrated in FIG. 1 is of the type including a printer frame having snap-together parts to facilitate assembly with robotic techniques. This particular printer assembly is illustrated in detail in copending application Ser. No. 619,228, filed June 11, 1984. Only so much of the printer assembly is illustrated as is necessary to an understanding of the present invention and reference may be made to said copending application for an illustration and description of any parts which are not disclosed in the present application.

As illustrated in FIG. 1, the printer includes an outer housing 10 with a removable access cover 11 and suitable feed rolls, not shown, for feeding a document D into the printer for printing indicia thereon. The forward end of a support end frame, broadly indicated at 12, is held in position by a flexure latch member 13 fixed on the base of the printer (FIG. 1) and adapted to engage and hold in position a locking tongue 14 integrally formed on the front end of the support frame 12.

The mounting arrangement of the present invention is adapted to support a conventional type of facemounting electric motor, broadly indicated at M, and having a housing 15 with a drive shaft 16 extending out of one end of the housing 15. A mounting flange 17 is fixed to one end of the housing 15 and includes an annular bearing surface 18 on the inner face of the mounting flange 17 and surrounding the drive shaft 16. At least a pair of mounting ears 19, illustrated as three in FIGS. 2 and 3, extend outwardly from the mounting flange 17. A pair of the mounting ears 19 extends outwardly from substantially diametrically opposed positions at opposite sides of the mounting flange 17. Mounting openings or holes 20 are formed in the mounting ears 19 and are concentric with the drive shaft 16. The mounting holes 20 are normally provided in the mounting flange 17 for receiving mounting screws or bolts for supporting the motor M in a right-angular position on a support frame or plate.

Figure 3:
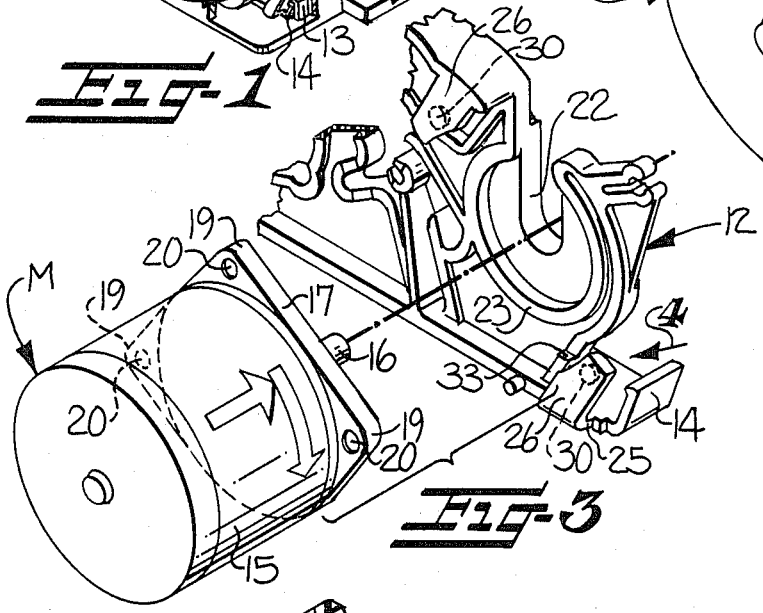
FIG. 3 is a view similar to FIG. 2, at a reduced scale, and with the electric motor separated from the support frame.

The support end frame 12 is molded of polymer material, preferably glass fiber filled polycarbonate including a lubricating material, such as Teflon, and including integrally formed molded bearings for receiving drive and guide shafts and the like. An opening 22, illustrated in the form of a U-shaped slot in FIG. 3, is provided in the support end frame 12 for passage of the drive shaft 16 therethrough. An integrally molded annular bearing surface 23 is provided on the side of the support end frame 12 adjacent the motor M (FIG. 3). The annular bearing surface 23 is illustrated in the form of an outwardly projecting raised rib adapted to act as an aligning guide and closely surround the annular bearing surface 18 of the motor M when in assembled condition.

A pair of motor support members is provided on the support end frame 12 and each of the motor support members includes an inner portion or leg 25 and an integrally molded outer portion or spring leg 26 extending at substantially a right angle to the inner leg 25 and in substantially parallel spaced-apart relationship with one side of the support frame 12. It is preferred that the spring leg 26 be molded so that it is inclined inwardly with its upper end being positioned inwardly toward the side of the support end frame 12 a distance which is slightly less than the thickness of the mounting ear 19 of the mounting flange 17. The upper inner portion of the spring leg 26 is provided with an inwardly inclined cam surface 27, for purposes to be presently described.

A cam projection 30 extends inwardly from the inner surface of the upper end portion of the spring leg 26 and is substantially semi-spherical with the flat inner surface thereof being integrally molded with the spring leg 26. The outer end portion of the semispherical cam projection 30 is truncated to provide a flat outer end, indicated at 32, and an inclined flat cam surface 31 (FIG. 4) extends downwardly from the flat end 32 and along one side of the cam projection 30, for purposes to be presently described.

As has been mentioned, the present mounting arrangement is particularly adapted for mounting the electric motor M to facilitate assembly with robotic techniques by simply positioning the motor M with its annular bearing member 18 in the annular bearing 23 on the support end frame 12. The motor M is then rotated in a clockwise direction until the mounting holes 20 on diametrically opposed sides of the motor snap into locked position in engagement with the semi-spherical cams 30 on the support member spring legs 26. It is preferred that the base portions of the semi-spherical cam projections 30 be slightly larger than the mounting hole 20 so that when the semi-speherical cam projections 30 are positioned in these openings or holes 20, they are not quite fully seated and the spring leg 26 remains in a slightly outwardly flexed position to resiliently maintain the mounting flange 17 in a rigidly locked position.

Figure 5:
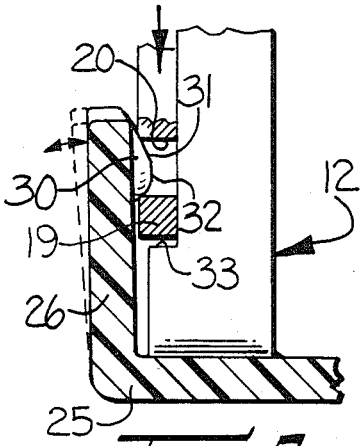
FIG. 5 is an enlarged sectional view taken substantially along the line 5—5 in FIG. 2.
Figure 6:
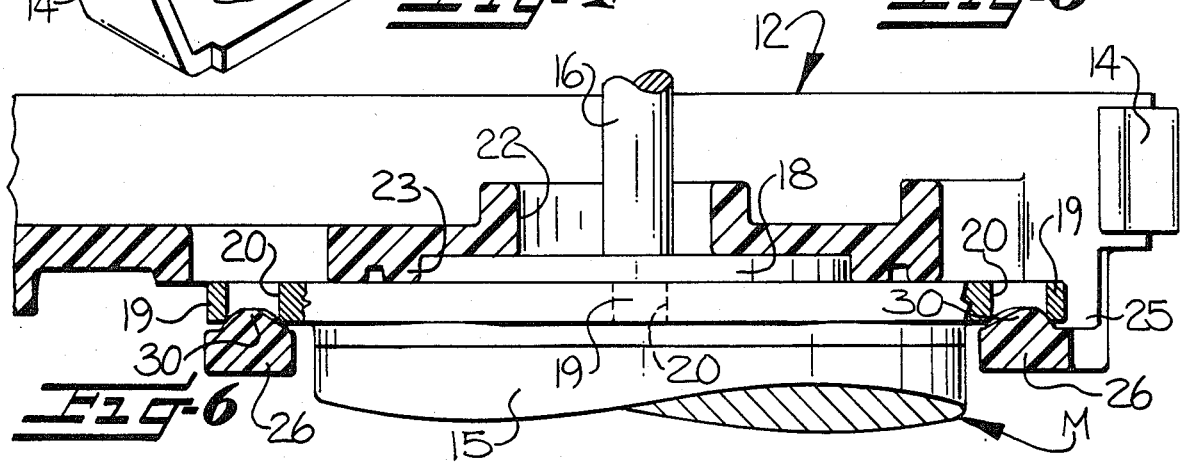
FIG. 6 is an enlarged sectional view taken substantially along the line 6—6 in FIG. 2.

When the motor M is positioned with its annular bearing member 18 in alignment with and within the annular bearing surface 23 of the support end frame 12 and the shaft 16 extends through the opening 22, the motor M is rotated in a clockwise direction, as indicated by the arrows in FIG. 3, so that the leading edges of the mounting ears 19 initially engage the cam surface 27 on each of the spring legs 26 and begin to move the free ends outwardly away from the inner surface of the support end frame 12. With further rotation, the mounting ears 19 engage the inclined flat cam surface 31 and move the free end of the spring leg 26 further outwardly, as indicated in dotted lines in FIG. 5, until the semispherical cam projections 30 snap into position in the mounting holes 20, where the electric motor M is resiliently supported.

Stop means, in the form of a stop ledge 33, is integrally molded on the inside of the forward end portion of the support end frame 12 to provide limited clockwise rotational movement to be imparted to the motor M. If the motor M is rotated beyond the position where the cam projection 30 is centered in the hole 20, the edge of the mounting ear 19 will engage the stop ledge 33 and the major portion of the cam projection 30 will still be positioned within the confines of the mounting hole 20. Upon release of the motor rotating force, the cam projection 30 will center itself in the mounting hole 20, because of the semi-spherical configuration thereof.

The motor M can be removed by applying a greater rotating force in a counterclockwise direction than the amount of clockwise force required to mount the motor M. When the proper amount of rotational force is applied to the motor M in a counterclockwise direction, the outer edge of the opening 20 will first ride up the curved side portion of the semi-spherical cam projection 30, opposite the inclined flat cam surface 31, so that the cam projection 30 will be moved outwardly, along with the corresponding spring leg 26 to release the motor M for removal. Since the curved side portion of the cam projection 30 is steeper than the inclined cam surface 31, a greater amount of rotational force is required to remove the motor M than to mount it.

Figure 2:
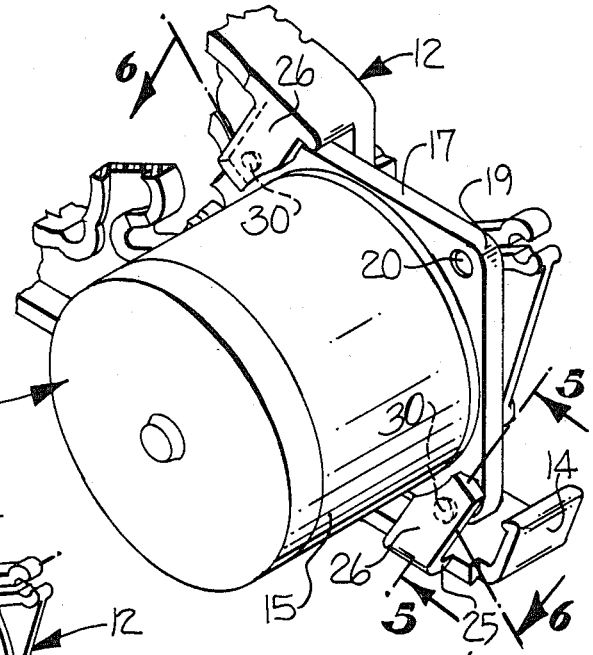
FIG. 2 is an enlarged fragmentary isometric view showing the electric motor mounted on the supporting end frame of the printer.
Figure 4:
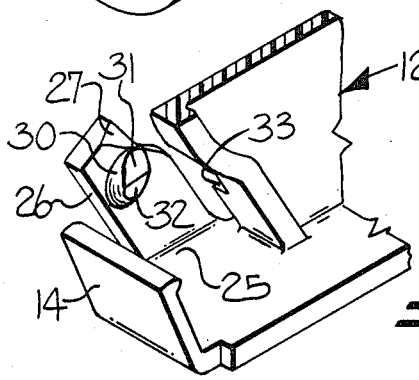
FIG. 4 is an enlarged fragmentary isometric view of the front end portion of the supporting end frame, looking in the direction of the arrow 4 in FIG. 3.

It will be noted in FIGS. 2 and 4 that the spring legs 26 are inclined at an angle from the corresponding bottom and top portions of the support end frame 12 so that they extend generally parallel to the rotational path of travel of the holes 20 in the mounting flange 17 when the motor M is rotated. This inclined positioning of the spring legs 26 provides a slightly longer spring arm than would be the case if these spring legs 26 were mounted in right-angular relationship to the bottom and top portions of the support end frame 12.

In the drawings and specification there has been set forth the best mode presently contemplated for the practice of the present invention, and although specific terms are employed, they are used in a generic and descriptive sense only and not for purposes of limitation, the scope of the invention being defined in the claims.

That which is claimed is:

1. A mounting arrangement for supporting a face mounting electric motor including a motor housing with a drive shaft extending out of one end thereof, a mounting flange fixed to said housing and including a bearing surface adjacent said drive shaft, a pair of mounting ears extending outwardly from substantially diametrically opposed positions at opposite sides of said mounting flange, and mounting openings formed in said mounting ears and being concentric with said drive shaft, said mounting arrangement comprising a support frame for supporting said electrtic motor in a right-angular position thereon, an opening for passage of said drive shaft through said support frame, a bearing surface on one side of said support frame and adjacent the opening and adapted to mate with said bearing surface on said mounting flange, a pair of motor support members including inner portions fixed on diametrically opposed sides of said openings in said support frame, outer portions extending at substantially a right angle to said inner portions and in spaced-apart relationship with said support frame, said outer end portions having inner surfaces spaced from said one side of said support frame substantially the same distance as the thickness of said flange mounting ears, and cam projections extending inwardly from the inner surface of each of said outer end portions of said support members, said support members being sufficiently resilient that their outer portions are moved outwardly with engagement of said cam projections by said flange mounting ears, said cam projections being positioned and dimensioned to engage the openings in said mounting flange ears with positioning of said bearing surface of said mounting flange against said bearing surface of said support frame and rotation of said electric motor and said mounting flange to resiliently maintain said mounting flange in rigidly locked position on said frame.

2. A mounting arrangement according to claim 1 wherein said support frame is molded of polymer material, and wherein said support members are integrally molded with said support frame.

3. A mounting arrangement according to claim 2 wherein said cam projections are integrally molded with said outer portions of said support members.

4. A mounting arrangement according to claim 2 wherein said polymer material comprises glass fiber filled polycarbonate.

5. A mounting arrangement according to claim 1 wherein said cam projections are substantially semi-spherical with the flat surface thereof fixed being integrally molded with the inner surface of said outer portions of said support members.

6. A mounting arrangement according to claim 5 wherein the portion of said semi-spherical cam projection adjacent the corresponding inner surface of said outer portion of said support member is slightly larger than the corresponding opening in said mounting ear so that said semi-spherical cam projection is not fully seated in the opening when in the locked position to maintain inwardly directed resilient pressure on said support member.

7. A mounting arrangement according to claim 5 including an inclined flat cam surface formed on each of said semi-spherical cam projections and positioned to be engaged by said flange mounting ears when said mounting flange is rotated in the direction of the locking position.

8. A mounting arrangement according to claim 7 including stop means and positioned to be engaged by one of said mounting ears to prevent rotation of said mounting flange beyond a predetermined position when said mounting flange is rotated in the locking direction.

9. A mounting arrangement according to claim 1 wherein the inner surfaces of said outer end portions of said support members are normally positioned closer to the side of said suport frame than the thickness of said flange mounting ears, and wherein an inclined cam surface is provided on said outer portion of each of said support members and adjacent said cam projection, said inclined cam surfaces being engageable by said flange mounting ears for resiliently moving said support members outwardly when said electric motor is rotated in the direction of the locking position.

10. A mounting arrangement for supporting a face-mounting electric motor comprising a motor housing with a drive shaft extending out of one end thereof, a mounting flange fixed to said housing and including a bearing surface adjacent said drive shaft, a pair of mounting ears extending outwardly from substantially diameterically opposed positions at opposite sides of said mounting flange, and mounting openings formed in said mounting ears and being concentric with said drive shaft, said mounting arrangement comprising a support frame of molded polymer material for supporting said electric motor in a right-angular position thereon, an opening for passage of said drive shaft through said support frame, a bearing surface on one side of said support frame and adjacent the opening and adapted to mate with said bearing surface on said mounting flange, a pair of motor support members integrally molded with said support frame and including inner portions fixed on diametrically opposed sides of said opening in said support frame, and outer portions extending at a right angle to said inner portions and in spacedapart relationship with said support frame, said outer end portions having inner surfaces spaced from said one side of said support frame substantially the same distance as the thickness of said flange mounting ears, and integrally molded semi-spherical cam projections extending inwardly from the inner surface of each of said outer end portions of said support members, said support members being sufficiently resilient that their outer portions are moved outwardly with engagement of said cam projections by said flange mounting ears, said cam projections being positioned and dimensioned to engage the openings in said mounting flange ears with positioning of said bearing surface of said mounting flange against said bearing surface of said support frame and rotation of said electric motor and said mounting flange to resiliently maintain said mounting flange in rigidly locked position on said frame.

11. A mounting arrangement according to claim 10 wherein said bearing surface on said mounting flange cooperates with said bearing surface on one side of said support frame for positioning said semi-spherical cam projections equidistant on opposite sides of said electric motor.

* * * * *